When the liner is assembled from prefabricated panels 110 as illustrated in FIG. 6, the liner may be conveniently made self-supporting by providing marginal lips 160 on either side of the bottom and top panels 110 at the duct assembly bottom and top, respectively. The vertical panels 110 on either side wall of the duct assembly can be fitted between these lips 160. Thus, the bottom panel 110 at the bottom of the duct assembly supports the vertical panels 110 on either side wall of the duct assembly and the vertical panels 110 on the sides of the duct assembly support the top panel 110 at the top of the duct assembly.

The ends of the corrugations 120 may be mitered as illustrated in FIGS. 5 and 6 to accommodate a miter engagement at each corner of the duct assembly 100. To provide a leak-tight liner structure, suitable conventional cold joint seals are made between adjacent panels 110.

Modifications of Certain Features

In both the first and second embodiments of the duct assembly described above, the spacer material (40 or 140) is preferably adhesively secured to the inner surface of the outer support duct. This is done primarily to assist in construction of the duct assembly while the liner is properly formed or assembled in the outer support duct. However, other means for holding the spacer material in place may be employed provided that such other means do not impose substantial resistance to relative movements that may occur between the outer support duct and the liner.

One alternate means (not illustrated) for holding the spacer material in place on the outer duct contemplates the use of relatively thin, and easily deformable, studs that are welded endwise to the inside surface of the outer support duct. The spacer material would then be compressed against, and impaled on, the studs. Suitable spring clip speed nuts or similar fasteners could be applied over the ends of the studs to hold the compressible spacer material in place.

Subsequent application of the liner to the inner surface of the spacer material would necessarily bring the liner into contact with the projecting distal ends of the studs and/or portions of the retaining clips. This engagement between the liner and the studs and clips would add some amount of resistance to movement of the liner relative to the outer support duct. However, with a sufficiently thick liner, and with relatively thin and yielding studs, the resistance to thermal expansion of the liner would be insignificant. As the liner expanded thermally, movement of the liner would bend or otherwise deform the studs and retaining fasteners. Of course, to the extent that the spacer material is also either frictionally engaged or actually bonded to the liner, the spacer material also must be sufficiently yielding to minimize any resistance to the thermal expansion of the liner.

As explained above for large duct assemblies having horizontal runs, it is preferred to install on the horizontal bottom wall of the duct assembly a spacer material that is substantially less compressible or less yielding in the direction normal to the outer duct inner surface than is the spacer material on the sides and top of the duct assembly. However, it is not necessary that such a construction be provided in order for the duct assembly to function properly in accordance with the broad principles of the present invention.

This is especially true in vertical riser sections of a duct assembly wherein there is no horizontal load bearing region that will be subjected to substantial weight loads (e.g., fly ash or workers) normal to the inside surface of the outer support duct. In such a section of duct assembly, the spacer material on all sides of the duct assembly may then be uniformly yielding in the direction normal to the duct inner surface.

Third Embodiment

FIG. 7 illustrates a third embodiment of the duct assembly liner structure of the present invention installed in an outer support duct 218. The duct assembly liner structure is designed to accommodate substantial off site (e.g., factory) prefabrication of the duct assembly liner.

Specifically, liner members 210A, 210B, and 210C are fabricated and assembled off site with a sheet of yielding spacer material 240 to form a composite panel. A plurality of such panels are then installed in the outer support duct 218. In a preferred form of the invention, each member 210A, B, and C is preferably shop fabricated as a laminate of at least one layer of conventional fiberglass mat and at least one layer of conventional fiberglass woven roving fabric. These two layers (not individually distinguishable in FIG. 7) are then bonded together, as with a layer of polyester resin, to form one of the members 210A, 210B, or 210C.

The bonding together of the mat and woven fabric into a member 210A, B, or C may be effected on a suitable mold or form to provide the member with a shape that will conform to a selected portion of the duct interior configuration and to provide the member with one or more corrugations (not illustrated, but similar to the corrugations 86 that are described above with reference to the first embodiment illustrated in FIGS. 1–4). The resulting laminate member typically has a thickness ranging between about 1.59 mm. and 3.18 mm. Not every member need be provided with corrugations—depending on the size of the member and its ultimate location in the outer support duct.

The members 210A, B, and C are preferably bonded together in a layered array or stack with a suitable agent 211 (e.g., a polyester resin) in an offset or staggered orientation as illustrated in FIG. 7. This accommodates the subsequent on site interfitting placement of the bonded members 210A, B, and C in the outer support duct 218 adjacent a similarly bonded set of members so as to create offset interfaces between the adjacent members of each layer. Thus, each member 210B will overlap a portion of an adjacent member 210A and each member 210C will overlap a portion of an adjacent member 210B. The overlapping regions, designated in FIG. 7 by reference letter M and reference letter N, are bonded in the field with a suitable bonding compound, such as polyester resin.

The spacer material 240 is preferably adhered, with polyester resin or some other suitable compound 211, to the surface of the first member 210A during off site fabrication of the members 210A, B, and C. The spacer material 240 may be identical to the spacer material 40 described above with reference to the first embodiment illustrated in FIGS. 1–4. As with the first embodiment, the type of the spacer material 240 used in the outer support duct load bearing region (e.g., bottom) preferably has substantially more resistance to compression generally normal to the inner surface of the outer support duct than does the type of spacer material covering

WORKOVER RIG SUPPORT APPARATUS

BACKGROUND OF THE INVENTION

The present invention relates to a device for use when maintenance work is being performed on an existing oil or gas well having two or more strings or pipe running therefrom. In particular, the present invention is related to a device for distributing the force exerted downward by maintenance equipment on a wellhead over the horizontal surface of the wellhead rather than concentrating the force on a single threaded connection.

It is common practice in the oil and gas industry to install what is known as a "Christmas Tree" on a completed gas or oil well. Some Christmas trees have provisions for receiving two or more strings of pipe contained in one well, each string producing oil or gas from a separate zone. Such Christmas trees are well known in the art and are in wide spread use in the oil industry. For example, U.S. Pat. No. 2,889,886 contains a description of a Christmas Tree in column 1 thereof. Various other wellhead apparatuses are disclosed in U.S. Pat. Nos. 3,028,917; 3,050,120 and 3,059,698.

Occassionally it is necessary to perform maintenance operations on completed wells having a Christmas tree connected thereto. Such maintenance work includes sand washing with fluid, nitrogen or foam, fishing for lost wireline tools, washing perforations and acidizing, running and pulling production strings, resetting weight on packers, and the like.

To perform such maintenance work, a large amount of heavy equipment must be attached to the top of the Christmas tree over the individual string of pipe which is being maintained. The equipment above the Christmas tree is generally referred to as a hydraulic workover unit or workover apparatus and may actually perform the maintenance work on the individual string of pipe while the pipe is under pressure from the fluids in the pipe. Such hydraulic workover equipment is very heavy and extends a considerable distance above the top of the Christmas tree to which it is connected. This distance may range from ten (10) to thirty (30) feet or more above the top of the Christmas tree. To hold this equipment in position, commonly cables or guy wires are extended from the equipment to the ground.

Almost the entire weight of the equipment above the Christmas tree is concentrated on a single threaded connection in the Christmas tree into which the bottom of the hydraulic workover unit is threaded. Forces as great as 60,000–80,000 pounds may be applied to the single threaded connection in the Christmas tree leading to the string of pipe on which maintenance operations are being performed.

Thus, it can be seen that such heavy equipment extending far into the air above the Christmas tree and the weight concentrated on a single threaded connection, which may vary from $2\frac{3}{8}$ to $2\frac{7}{8}$ inches in diameter, presents a very dangerous condition for the workmen in the area and for the equipment being utilized. If the hydraulic workover equipment is not balanced carefully on the Christmas tree, the bottom portion of the workover equipment which is threaded in the Christmas tree can easily be broken due to the great amount of weight being concentrated on a small threaded connection. In the past many serious accidents have occurred due to the cracking or breaking of the pipe extended from the hydraulic workover unit and threaded into the Christmas tree. Such a cracking or breaking can result in the collapse of the entire hydraulic workover rig and injury to personnel in the vicinity.

Accordingly, it is an object of the invention to provide a means for distributing the weight of a hydraulic workover unit connected to a Christmas tree over the horizontal surface of the Christmas tree rather than entirely on the threaded connection into which the bottom portion of the hydraulic workover rig is connected.

THE INVENTION

In accordance with the present invention there is provided an apparatus for distributing the weight of a workover or maintenance apparatus connected to a Christmas tree over the surface of the portion of the Christmas tree to which the workover apparatus is attached, including a plate which rests upon the portion of the Christmas tree to which the workover apparatus is attached, and a rigid support means extending upwardly from the plate, the rigid support means being connectable to said workover apparatus. The apparatus may include means for plugging the other strings of tubing contained in the Christmas tree to which the workover apparatus is not attached, and means for adjusting the length of the rigid support means.

The apparatus of the invention aids in preventing dangerous and costly accidents which occur during maintenance or workover operations on gas and oil wells. Furthermore, the apparatus of the invention permits workover or maintenance operations to be performed much more rapidly. Use of the apparatus of the invention results in a more stable and less vulnerable workover apparatus which can be placed in position on the Christmas tree and removed more rapidly than workover apparatuses which do not employ the invention.

DESCRIPTION OF THE PREFERRED EMBODIMENT

Figure 1:
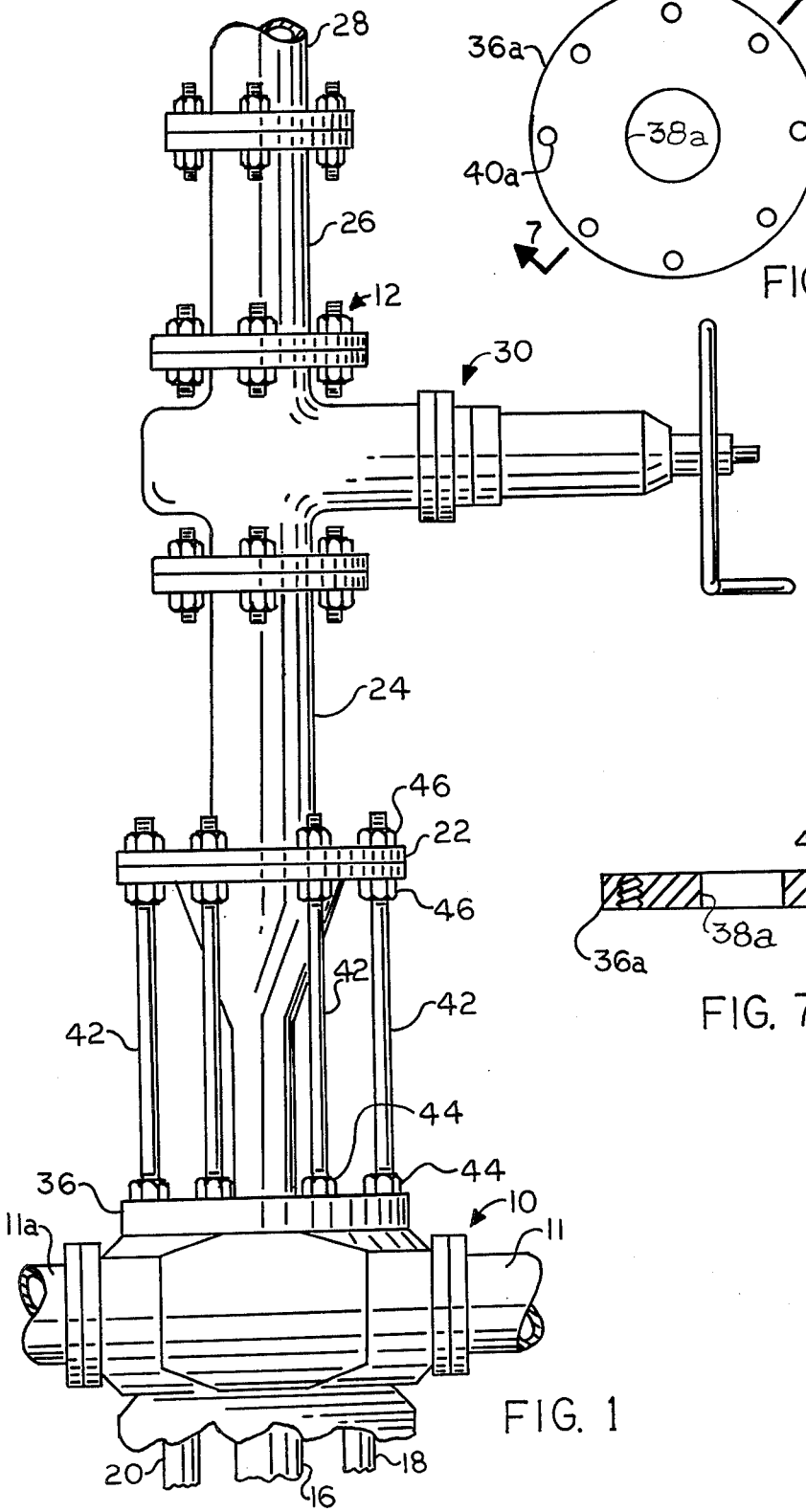
FIG. 1 is a partially cut-away, side elevational view of the invention connected to the top of the Christmas tree and to the bottom of a conventional workover or maintenance apparatus.
Figure 6:
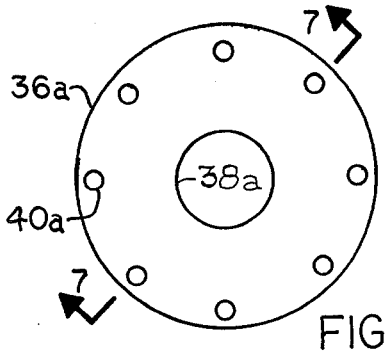
FIG. 6 is a top plan view of another embodiment of the invention.
Figure 7:
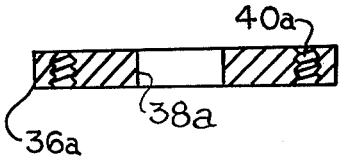
FIG. 7 is a cross sectional view taken along lines 7—7 of FIG. 6.

Referring now to the drawings, in FIG. 1 is shown the top portion of a Christmas tree generally indicated by the numeral 10. The bottom portion of the Christmas tree is not shown. The top portion 10 has two pipes 11 and 11*a* attached thereto, although any conventional number of pipes could be used.

Attached to the upper portion of the Christmas tree 10 is a workovering or maintenance apparatus generally indicated by the numeral 12. Such workover or maintenance apparatus are commonly used in the oil and gas industry to perform various maintenance operations on gas and oil wells such as sand washing with fluid, nitrogen or foam, fishing for lost wireline tools, washing perforations and acidizing, running and pulling production strings, reseting weight on packers, and the like. Such workover rigs are sometimes referred to as hydraulic workover units. The workover apparatus extends from the top 13 of the Christmas tree 10 up to a height as great as 20 to 30 feet or more above the Christmas tree. The workover apparatus comprises a series of pipes and valves through which fluids and equipment can be introduced into the various strings of pipe or tubing contained in the Christmas tree through which gas and oil have been produced.

Figure 2:
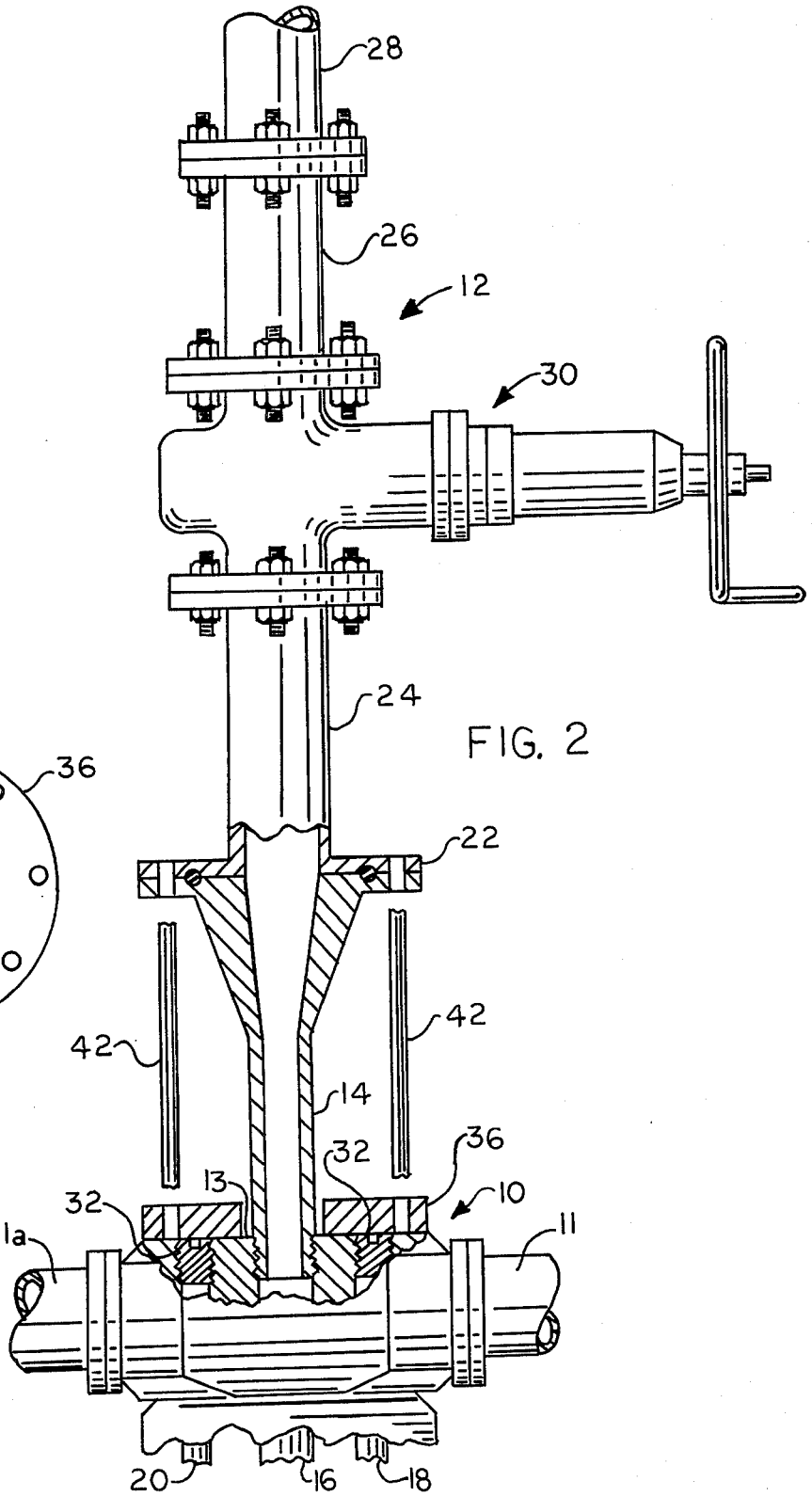
FIG. 2 is a partially cut-away, partially cross-sectional view of the apparatus shown in FIG. 1.

As can be seen in FIGS. 1 and 2, at the bottom of the workover apparatus 12 is threaded joint 14 which is shown threaded into the top 13 of Christmas tree 10. By threading the bottom portion 14 into Christmas tree 10 the workover apparatus 12 is thereby aligned with the center string of tubing 16 which extends into and is contained by Christmas tree 10.

As can be seen in the drawings, two additional strings 18 and 20 are also contained in the Christmas tree. The Christmas tree could have only two strings of tubing extending therefrom, or three or more. The apparatus of the invention is equally applicable to Christmas trees with two or more strings of tubing extended therefrom.

Figure 5:
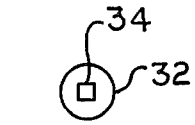
FIG. 5 is a top view of the plug of FIG. 4.
Figure 4:
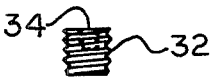
FIG. 4 is a side elevational view of a plug inserted into one of the multiple strings of pipe contained in the Christmas tree.
Figure 3:
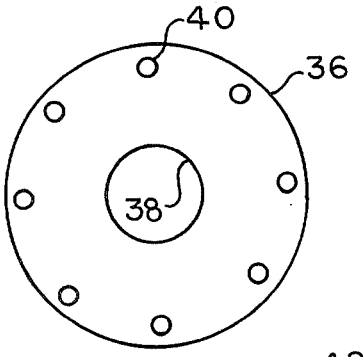
FIG. 3 is a top plan view of the invention which rests upon the top of the Christmas tree.

The threaded joint 14 is connected by flanges 22 to the upper portion of the workover or maintenance apparatus 12, which may include additional joints 24, 26, 28, the valve generally indicated by the numeral 30, and the like. A typical workover apparatus may have one or more valves and several flanged connections. As can be seen in FIG. 2, the tubing strings 18 and 20 have been sealed with plugs 32. Plugs 32 are threaded plugs shown in detail in FIGS. 4 and 5 which have a square slot 34 in the top thereof for receipt of a wrench. As can be seen in FIG. 2 the plugs are received in threaded holes in the top of the Christmas tree head 10. When the apparatus of the invention and the workover apparatus is removed from the Christmas tree these plugs are generally replaced with pressure gauges, wireline connectors, or the like.

To distribute the weight of the workover apparatus 12 over the top of the Christmas tree 10 in accordance with the present invention, there is provided a plate 36 which has a hole 38 in the center thereof for receipt of threaded joint 14. The plate 36 has a series of holes 40 therein in which may be fitted a series of bolts 42 having nuts connected thereto at each end. At the bottom of bolts 42 are nuts 44 and at the top of bolts 44 are two nuts 46 with flanges 22 therebetween. Holes 40 are preferably threaded as shown by the numeral 40*a* in plate 36*a* having hole 38*a* therein to receive bolts 42, although they could have no threads, if desired.

It can thus be seen that by connecting plate 36 as shown in the drawings, the nuts 46 and 44 can be adjusted on bolts 32 to exerted force downwardly from flange 22 onto the top of Christmas tree 10, thus reducing the amount of force that is on threaded joint 14, and distributing the weight of workover apparatus 12 more evenly over the top of Christmas tree 10. Furthermore, the force exerted by bolts 42 downwardly on the top 13 of Christmas tree 10 is at a distance away from the center line of the workover apparatus, and thereby assists in stabilizing the workover apparatus or rig 12 extending above Christmas tree 10. The workover rig 12 can be aligned vertically by individually adjusting bolts 42.

Although the bolts 42, in combination with the nuts in plate 36 are preferred, if desired, other means may be used to attached plate 36 to the workover apparatus 12. For example, bolts 42 could be replaced with a turnbuckle type of mechanism which would be adjustable between plate 36 and flange 22.

As will be readily understood those skilled in the art, after the maintenance work is performed on tubing 16, the workover apparatus 12 can be unscrewed from the top of the Christmas tree after loosening the bolts 44 on plate 36. One of the plugs 32 removed and the apparatus moved over to work on, tubing string 18 or 20.

The plate 36 may be made of any diameter desired. For example, plate 36 can be larger than the diameter of the top of the Christmas tree 10, so that when the workover apparatus is moved from one string to another, the entire top of the Christmas tree is covered by the plate 36.

Although the preferred embodiments of the present invention have been disclosed and described in detail above, it should be understood that the invention is in no sense limited thereby, and its scope is to be determined by that of the following claims.

What is claimed is:

1. An apparatus for distributing the weight of a workover rig connected to a Christmas tree over a surface of a portion of the Christmas tree to which the workover rig is attached, comprising:

A. threaded pipe joint means for connecting a workover rig to a Christmas tree, said threaded pipe joint means having an upper end and a lower end, said lower end having threads thereon for screwing said threaded pipe joint means into the top of a Christmas tree, said upper end having flange means thereon for connecting said upper end to a workover rig, said flange means having a top side and a bottom side, said threaded pipe joint being hollow inside, B. plate means for distributing the weight of a workover rig over the surface of the portion of the Christmas tree to which the workover rig is attached, said plate means being connectable to said threaded pipe joint means and adapted to be placed upon the top of the portion of said Christmas tree to which the workover rig is attached, said plate means having a large hole in the center thereof through which said lower end of said threaded pipe joint extends, said plate means have a plurality of smaller holes therein for receipt of bolt means, C. support means connectable to said plate means and to said threaded pipe joint means, said support means including i. a plurality of bolt means for connecting said flange means on said upper end of said threaded pipe joint means to a workover rig and to said plate means, said bolt means having threads on the upper end thereof for receipt of nut means, ii. nut means connectable to said upper end of said bolt means beneath said bottom side of said flange means for applying an upward force to said flange means, iii. means connectable to the lower end of said bolt means for applying a downward force on said plate means.

2. The apparatus of claim 1 wherein said smaller holes in said plate means are threaded.

3. The apparatus of claim 2 wherein the lower end of said bolt means is threaded.

4. The apparatus of claim 3 wherein said means connectable to the lower end of said bolt means comprises nut means.

5. The apparatus of claim 4 wherein a flanged pipe is connected to the lower end of a workover rig, the flange on said flanged pipe being adapted to be connected to said flange means on said threaded pipe joint.

6. The apparatus of claim 5 wherein said flange on said flanged pipe is connected to said flange means on said threaded pipe joint by said bolt means.

* * * * *